United States Patent [19]

Hodges

[11] 4,296,970

[45] Oct. 27, 1981

[54] HYDRAULIC MINING TOOL APPARATUS

[76] Inventor: Everett L. Hodges, 49 Royal St. George, Newport Beach, Calif. 92660

[21] Appl. No.: 121,712

[22] Filed: Feb. 15, 1980

[51] Int. Cl.[3] ..... E21C 45/00

[52] U.S. Cl. ..... 299/67; 37/61; 37/65; 175/67; 175/213; 175/215; 299/17; 299/18; 406/61

[58] Field of Search ..... 299/17, 18, 56, 64, 299/87, 67, 68; 175/67, 102, 213, 215, 394; 37/61, 62, 65; 406/61

[56] References Cited

U.S. PATENT DOCUMENTS

| | | | |
|---|---|---|---|
| 842,364 | 1/1907 | White | 37/61 |
| 1,759,490 | 5/1930 | Neveling | 37/61 X |
| 3,472,553 | 10/1969 | Miller | 299/5 |
| 4,140,346 | 2/1979 | Barthel | 299/17 |

FOREIGN PATENT DOCUMENTS

| | | | |
|---|---|---|---|
| 755011 | 11/1933 | France | 175/394 |

*Primary Examiner*—Ernest R. Purser
*Attorney, Agent, or Firm*—Kit M. Stetina

[57] ABSTRACT

An improved hydraulic mining tool for recovering minerals, particularly bitumen, and other viscous crude oils, from subterranian formations is disclosed, composed generally of a radially directed cutting jet nozzle which discharges a high velocity liquid to dislodge bitumen, viscous crude oils, and sand particles from the formation and a venturi-type pump and jet nozzle which lifts the dislodged material upward to the surface. The mining tool includes a rock crushing mechanism having means to vary its impact force and reciprocation frequency and an Archimedes feed screw which provides a variable quantity, continuous feed of mined material into the jet pump inlet.

11 Claims, 2 Drawing Figures

Fig. 1
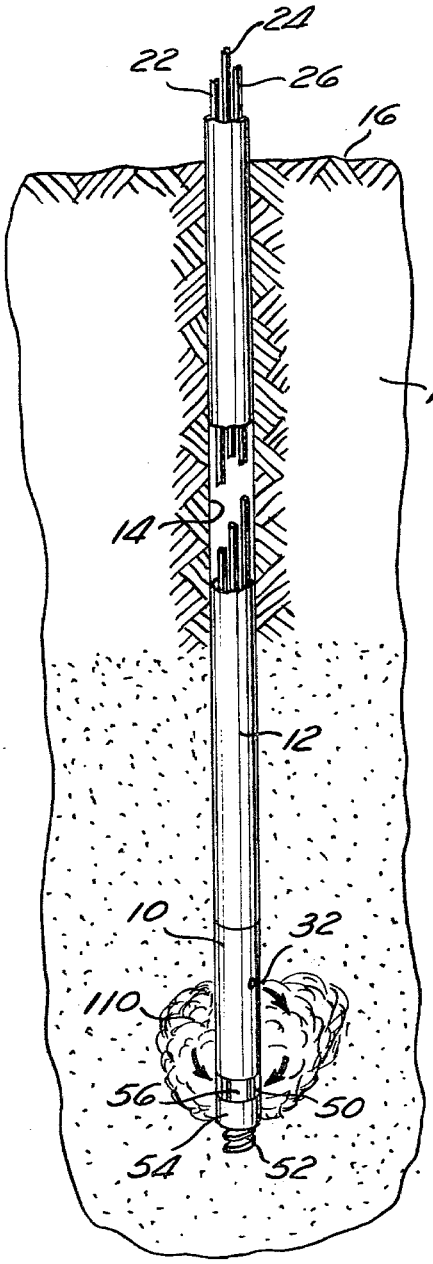
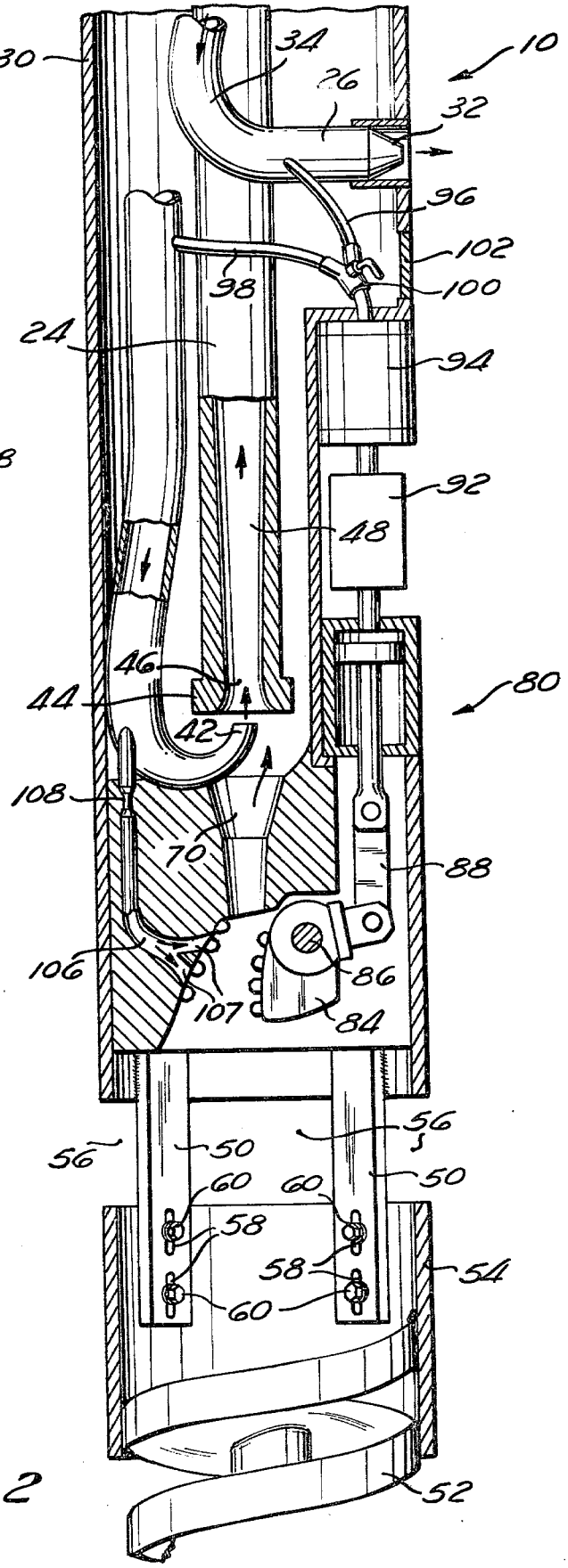
Fig. 2

HYDRAULIC MINING TOOL APPARATUS

BACKGROUND OF THE INVENTION

The present invention relates to mineral recovery, and more particularly to bitumen and viscous crude oil recovery by use of hydraulic mining techniques.

With the world demand for petroleum products rising to unprecedented levels and the known accumulated oil reservoir supplies being rapidly depleted, attention has been directed to means for recovering high viscosity crude oil from subterranean mineral deposits such as tar sands or bitumen sands which are known to contain substantial crude oil reserves. Due to the high viscosity of the crude oil carried in the tar sands, and the low reservoir pressures generally found in these shallow oil formations, conventional petroleum recovery techniques are rendered ineffective by various environmental and regulatory restrictions and prove to be generally unsuitable for extracting the crude oil from the shallow formation sand deposits. Additionally, the extraction of such viscous crude oil through steam injection proves ineffective in many of the shallow oil formations.

Heretofore, the recovery of such high viscosity crude oil was typically accomplished by either strip mining, wherein the tar-like sand deposits are removed by mechanical means and transported to the surface for subsequent separation of the crude oil from the same or in-situ separation, wherein the crude oil is separated in place from the tar-like sands by use of thermal processes to reduce the viscous properties of the crude oil, and subsequently pumped to the surface. The use of the strip mining and in-situ separation methods have been found to be extremely cost prohibitive, and often unable to meet environmental and other regulatory requirements. As such, the mining of tar sands has remained relatively dormant.

Very recently, hydraulic mining techniques have been developed which have proven to be more economical in the recovery of the high viscosity crude oil and generally compatible with the various environmental and regulatory requirements. Basically, such hydraulic mining techniques utilize a high velocity liquid which is discharged into the tar sand formation, to dislodge the viscous crude oil and sand particles therefrom. The freed viscous crude oil and oil encapsulated sand particles mix with the high velocity liquid discharge forming an aqueous slurry which may be pumped, as by way of a hydraulic jet pump, to the surface and subsequently processed by conventional surface systems to yield a separation of the viscous crude oil from the sand particles. Techniques such as steam cycle, steam drive, and in-situ combustion, heretofore used to recover viscous crude oil, require significant amounts of crude oil to be used as fuel to provide energy for the process. As such, the recent hydraulic mining techniques drastically increase recovery efficiency and save valuable resources. Examples of such recent hydraulic mining tools are U.S. Pat. No. 3,439,953, issued to Pfefferle, U.S. Pat. No. 3,951,457, issued to Redford, and my co-pending patent application, Ser. No. 053,029, filed June 28, 1979, entitled DOWN HOLE PUMP WITH BOTTOM RECEPTOR, the disclosures of which are expressly incorporated herein by reference. Although these recently developed hydraulic mining tools have proven to be more cost effective in the recovery of viscous crude oil from tar sands than the previous strip mining and in-situ separation mining methods, they have possessed certain inherent deficiencies which have detracted from their overall efficiency during operation.

These deficiencies have focused upon the tendency of the jet pump, utilized to lift the aqueous slurry upward to the surface, to become clogged with rocks, clay, formation debris, or other obstructions during operation, the inability of the mining tools to penetrate large rock formations and rock particles which accumulate under the mining tools during operation thereby restricting the lowering of the mining tool within the tar sands, and the typical failure of the mining tools to include any means to ensure that a constant slurry/tar sand supply be introduced into the jet pump.

In relation to the tendency for the jet pump nozzle to become obstructed during operation, it will be recognized that the viscous crude oil sand formations are often laced with various hard rock particles or formations which, during the mining process, migrate in the aqueous slurry toward the jet pump venturi throat. If the rock particle size is greater than the throat of the venturi, the particles become lodged therein, substantially reducing, if not completely closing off the slurry inlet to the jet pump. Although this problem has been recognized with more recent mining tool designs incorporating screen meshes over the jet pump venturi throat, such screens are subject to being torn during operation and further are often themselves subject to becoming clogged by the high viscosity crude oil released from the tar-like sand formations and restricted by the accumulation of mined rock particles adjacent the venturi pump inlet.

Additionally, most hydraulic mining tools have utilized a conical-shaped cutting auger at their lower-most end which, during rotation of the mining tool, permits the tool to be lowered deeper into the tar sand formation. Although effective in relatively consistent soft formations, such conical augers are incapable of penetrating hard rock formations which, as previously mentioned, are commonly interspersed or laced within the tar-like sand, and fail to remove large rock cuttings from the mining hole. As such, upon confronting a hard rock formation, these conical-shaped augers merely bounce thereon thereby preventing the tool from being lowered deeper into the tar-like sand formations. With the vertical depth of the mining tool limited, the amount of available slurry and mined material surrounding the mining tool is reduced, with the attendant reduction in slurry recovery.

Further, the existing hydraulic mining tools have typically relied solely upon the natural gravity force migration of the slurry within the formation and the suction developed by the jet pump to transport the slurry into the jet pump venturi throat. This lack of any positive means to supply the slurry into the venturi throat has resulted in varying recovery efficiencies, dependent upon the varying rate of migration of the slurry within the tar sand formation.

Thus, there exists a substantial need for a hydraulic mining tool which does not become clogged during operation, can penetrate hard rock formations and clear formation debris, and includes means to supply a continuous quantity of slurry into the jet pump venturi throat.

SUMMARY OF THE PRESENT INVENTION

The present invention comprises an improved hydraulic mining tool apparatus which significantly overcomes the problems heretofore associated in the art. Particularly, the present invention comprises a hydraulic mining tool which may be connected onto the bottom of a standard drill section and lowered within an existing bore hole. A pair of flow conduits is provided within the interior cavity of the mining tool, one of which directs a high pressure, high velocity liquid cutting jet radially outward from the mining tool, to dislodge viscous crude oil and oil encapsulated particles from the tar-like sand formation, and yield a resultant aqueous slurry; the other of which is positioned to direct a high volume, high velocity liquid flow through an eductor venturi, to create a jet pump which is utilized to transport the aqueous viscous crude oil and sand particle slurry to the surface.

The viscous crude oil/sand slurry is introduced into the jet pump through both radial and bottom inlets, the bottom inlet being formed by an Archimedes feed screw sleeve assembly which continuously lifts the tar sand material from the lower end of the bore hole upward into the jet pump venturi throat. The feed screw/-sleeve assembly is adjustable in an axial direction to vary the effective area of the radial slurry inlet thereby permitting metering of the amount of slurry entering through the radial inlet with respect to that entering through the bottom inlet. As such, the present invention may be utilized in differing type formations and consistencies, and ensures consistent recovery efficiency during operation by continuously supplying a quantity of viscous crude oil sand material upward through the bottom inlet as well as viscous crude oil/sand particle slurry through the radial inlet.

Additionally, the Archimedes feed screw/sleeve assembly is formed to ensure that a portion of the Archimedes screw extends vertically below the lower-most end of the sleeve. This extension of the screw permits the screw, during rotation of the mining tool, to thoroughly penetrate varying consistencies of hard rock formations, laced within the tar-like sands. Thus, the hydraulic mining apparatus of the present invention may be continuously lowered throughout the heighth of the tar sand formation to effectuate high efficiency viscous crude oil sand particle recovery during operation.

The present invention further incorporates a rock crushing mechanism, located between the radial and bottom inlets and the jet pump venturi throat, which effectively fractures the hard rock particles and larger tar-like sand particles prior to their entry into the venturi throat, thereby allowing these obstructing particles to be circulated to the surface. The rock crusher mechanism includes a movable jaw which reciprocates back and forth across the opening of the jet pump venturi throat being powered by a hydraulic piston control valve arrangement. The pistonis fed from either the cutting jet liquid supply or jet pump liquid supply or a combination of both, to permit variable reciprocation speed and cycle frequency of the movable jaw. Thus, the present invention effectively eliminates the obstruction and clogging problems associated in previous hydraulic mining tool apparatus.

Additionally, to ensure that the relatively dry tar sand material transported through the bottom inlet assumes a slurry condition prior to entry into the jet pump venturi throat, a supplemental liquid discharge supply is provided. The supplemental liquid supply includes a pressure and velocity reducer to discharge only a small quantity of liquid as desired into the area adjacent the bottom slurry inlet such that the jet pump action utilized to transport the viscous crude oil/sand particle slurry is not degraded.

DESCRIPTION OF THE DRAWINGS

These, as well as other features of the present invention, will become more apparent upon reference to the drawings, wherein:

FIG. 1 is a perspective view of the improved hydraulic mining tool apparatus of the present invention disposed within a bore hole and connected to a string of standard drill sections, illustrating the cutting jet conduit, jet pump conduit, and eductor conduit, extending within the interior of the drill string; and FIG. 2 is an enlarged cross-sectional view of improved hydraulic mining tool apparatus of the present invention removed from the bore hole of FIG. 1 and depicting the internal construction thereof.

DETAILED DESCRIPTION OF THE PREFERRED EMBODIMENT

Referring to FIG. 1, there is shown the improved hydraulic mining tool apparatus 10 of the present invention connected at its upper-most end by conventional means to one or more standard drill sections 12. The mining section 10 and drill section 12 is depicted lowered into a predrilled bore hole 14 which extends from the ground surface 16 downward through the overburden 18 and into a tar-like sand formation 20.

A jet pump supply conduit 22, jet pump eductor conduit 24, and cutting jet supply conduit 26 extend within the interior of the standard drilling section 12 initiating at a height above the ground surface 16, and terminating within the mining section 10. The uppermost end of the standard drilling section 12 is typically provided with a conventional Kelly section (not shown) and a three passage swivel (not shown) which permits rotation of the mining section 10, standard drilling section 12, and conduits 22, 24, and 26 while maintaining sealed connections of the supply conduits 22 and 26 with respective pumps (not shown) and the eductor conduit 24 with a search tank (not shown) located on the ground surface 16.

As shown in FIG. 2, the mining section 10 is formed having an outer cylindrical casing 30, the diameter of which is sized to be received within the standard bore hole 14 (approximately 12 inches). The cutting jet supply conduit 26 extends axially within the interior of the casing 30 being directed radially outward at its lower end to pass through the peripheral wall of the casing 30. The distal end of the conduit 26 is adapted to receive a cutting jet nozzle 32 which, in combination with plural turning vanes (not shown), located on the interior of the conduit 26 at the radial transition 34, directs liquid pumped through the cutting jet conduit from the ground surface 16, radially outward into the tar sand formation 20. In the preferred embodiment, the nozzle 32 may be formed in various sizes to increase or decrease the velocity of the liquid discharge, with the varying sizes being threadingly inserted onto the end of the conduit 26 prior to lowering of the mining section 10 within the bore hole 14.

The jet pump supply conduit 22 additionally extends axially within the interior of the casing 30 terminating at a distance below the lower end of the cutting jet conduit 26 and is directed to extend back upward, toward the ground surface 16. As shown, the conduit 22 includes a jet pump nozzle 42 which is aligned with the lower end 44 of the eductor conduit 24 rigidly mounted within the interior of the casing 30. The lower end 44 of the eductor conduit 24 is provided with a venturi 46 and an eductor mixing section 48. By such an arrangement, liquid pumped through the jet pump supply conduit 22 from the ground surface 16 is accelerated through the jet pump nozzle 42 and discharged upward through the eductor venturi 46. The force generated by the liquid discharge passing through the venturi 46 creates a suction at the lower end of the venturi 46 which, as will be explained in more detail infra, pulls the bitumen/sand particles slurry upward into the eductor conduit 24, wherein it mixes with the liquid discharge in the mixing section 48 for subsequent travel to ground surface 16.

As shown, the casing 30 is formed having an open tubular configuration and is provided with plural supports struts 50, which are rigidly connected along the interior surface of the casing and extend axially downward below the lower end thereof. The support struts 50 mount an Archimedes feed screw 52 and screw sleeve 54 which are connected to one another to form a rigid assembly. The screw 52 extends a short distance beyond the lower end of the screw sleeve 54 to be directly exposed to the tar sand formation 20 while the upper end of screw sleeve 54 is preferably axially spaced from the lower open end of the casing 30. The upper end of the screw sleeve 54 thus forms a bottom inlet 55 for the mining section 10, directing tar sands mined by the screw 52 upward toward the jet pump venturi 44, whereas the voids 56 formed between the plural support struts 50, form a radial inlet for the mining section 10, receiving the bitumen/sand particle slurry mined by the cutting jet nozzle 32.

In the preferred embodiment, the lower end of the support struts 50 each include a pair of elongate mounting slots 58 sized to receive a fastener 60 which may be threadingly inserted into mating apertures (not shown) formed in the upper end of the screw sleeve 54. As such, the effective size of the radial slurry inlets 56 may be adjusted prior to insertion of the mining tool 10 into the bore hole 14 by reciprocating the screw sleeve 54 along the length of the mounting slots 58 and subsequently tightening the fasteners 60 to lock the sleeve 54 in a desired position. This adjustability thereby provides a means for varying the amount of mined material entering into the casing 30 between the bottom and radial inlets to accommodate differences in slurry concentration and density of the particular tar sand formation.

The lower end of the casing 30 is additionally provided with a slurry transition throat 70 which is formed as a frusto-conical shaped aperture. The upper end of the transition throat 70 is aligned with the eductor venturi 46 and spaced a short distance therefrom such that the suction forces generated by the eductor venturi 46 are promulgated through the transition throat 70 and sensed at the lower end of the casing 30. Thus, mined material entering through the bottom and radial inlets 55 and 56 may be pulled upward through the lower end of the casing 30 and the transition throat 70 and into the eductor venturi 46.

A rock crusher mechanism, designated generally by the numeral 80, is provided within the mining section 10 of the present invention to ensure that mined sand and rock particles traveling into the slurry transition throat 70 are of a size sufficient to pass upward into the eductor venturi 46 without becoming lodged therein. The rock crusher mechanism 80 is composed generally of a fixed jaw 82 and movable jaw 84 which are disposed on opposite sides of the transition throat 70 and positioned proximal thereto. The fixed jaw 82 is pivotal about a mounting pin 86 rigidly attached to the casing 30 and is provided with a linkage 88 connected to a hydraulic cylinder/piston actuator 90. The hydraulic actuator 90 is connected in series with a valve control system 92 and filter 94, both of which are well known in the art, to permit selective reciprocation of the piston within the hydraulic actuator 90.

In the preferred embodiment, the hydraulic actuator 90 is powered by liquid flow tapped off from either the cutting jet nozzle conduit 26 or jet pump supply conduit 22 as by way of the crusher supply conduits 96 and 98, respectively. The conduits 96 and 98 are connected to the filter 94 through a butterfly valve 100 (shown schematically in FIG. 2) which permits the crusher mechanism 80 to be selectively connected in series to either the jet pump supply conduit 22 or cutting jet supply conduit 26 or in parallel with both conduits 22 and 26. By such an arrangement, it will be recognized that the pressures supplied to the rock crusher 80 may be varied between the values of the jet pump supply and cutting jet nozzles supply pressures which, in the preferred embodiment, is between 100 psi to 4,000 psi. Thus, the reciprocation speed of the hydraulic actuator 90 may be significantly varied by the manual adjustment of the butterfly valve 100 through the access panel 102, prior to insertion of the mining section 10 within the bore hole 14 while the reciprocation frequency may also be varied by the manual adjustment of the butterfly valve 100 through the access panel 102, prior to insertion of the mining section 10 within the bore hole 14 while the reciprocation frequency may also be varied by adjustment of the crusher control system 92. This variable reciprocation speed and frequency cycle of the crusher mechanism 80 permits the crusher mechanism 80 to be adjusted to suit the particular composition of the tar sand formation. For example, in formations known to have a relatively large quantity of hard rock formations, the crusher mechanism 80 may be preset to provide high impact speeds and rapid reciprocation cycles to thoroughly crush the particles prior to entry into the slurry transition throat 70; whereas in formations having predominant gum-like tar consistency, the impact force and reciprocation cycle may be lowered to provide a mashing action of the particles prior to entry into the transition throat 70. A piston port bypass 91 may be additionally provided on the actuator 90 to permit selective bleeding of the pressure within the actuator 90 during the mining operation as by introduction of ball plugs into the peripheral portion of the bore hole from ground surface.

As shown in FIG. 2, the mining section 10 additionally includes a supplemental liquid supply conduit 106 which extends from the lower end of the jet pump supply conduit 22 terminating adjacent the lower end of the casing 30. The supplemental liquid supply conduit 106 is utilized to transport a small quantity of liquid into the lower end of the casing 30 such that mined tar sands entering through the bottom inlet 55 is supplied with a sufficient quantity of liquid to assume a slurry condition. The supplemental liquid supply conduit 106 is preferably provided with a conventional restrictor 108 which reduces the pressure and velocity of liquid passing through the supplemental supply conduit 106 so that the jet pump action generated by the jet pump nozzle 42 and eductor venturi 46 is not disturbed during operation. Advantageously, the conduit 106 may be formed having one or more discharge outlets 107 which direct the supplemental liquid in the vicinity of the stationary jaw 82 of the rock crusher mechanism 80 to dislodge any gum-like tar sands accumulating during operation.

With the structure defined, the operation of the mining section 10 of the present invention may be described. Subsequent to the drilling of the borehole 14, using conventional drilling equipment, the mining tool 10, mounted onto the end of a standard drill section 12, is lowered into the bore hole 14. As will be recognized, suitable sealing means (not shown) are provided at the upper end of the mining section 10 to ensure that a liquid-tight seal is maintained between the jet pump supply conduit 22, jet pump eductor conduit 24, and cutting jet nozzle supply conduit 26 at the interface between the mining tool 10 and drill section 12.

The entire drill string (composed of the mining section 10 and standard drilling section 12) is subsequently rotated and a suitable liquid, such as water, is introduced through the jet pump supply conduit 22 and cutting jet nozzle supply conduit 26 by conventional pumps (not shown). The liquid introduced through the cutting jet supply conduit 26 is typically supplied at a high pressure (approximately 1000–4000 psi) and is accelerated through the cutting jet nozzle 32 to be directed raidally outward into the tar sand formation 20. Due to the high velocity and pressure of the liquid discharge, bitumen and sand particles are dislodged from the tar sand formation 20 and mixed with the liquid discharge to form a bitumen/sand particle slurry 110. Simultaneously, liquid is introduced through the jet pump supply conduit 22, preferably at a pressure of approximately 400 psi and is discharged through the jet pump nozzle 42 and into the eductor conduit 24. The liquid flow through the venturi 46 of the eductor 24 generates a reduced pressure or suction which is promulgated through the slurry transition throat 70 and sensed at the bottom and radial inlets 55 and 56, respectively.

As shown in FIG. 1, the slurry 110 migrates downward by gravity forces and is pulled through the radial inlets 56 by the suction forces developed by the jet pump nozzle 42 and eductor venturi 46. Additionally, the rotation of the mining section 10 causes the Archimedes feed screw 52 to continuously lift quantities of the tar sand formation 27 upward through the bottom inlet 55, the amount of which is dependent upon the length of the screw 52 extending below the adjustable sleeve 54. During this upward lifting, the relatively dry tar sand traveling upward through the screw sleeve 54 are mixed with the low velocity liquid being released from the supplemental liquid supply conduit 106 as well as the bitumen/sand particle slurry 110 entering through the radial inlet 56 to yield a generally homogenous slurry concentration. The suction forces generated by the jet pump nozzle 42 cause the resultant slurry to be drawn upward toward the lower end of the slurry transition throat 70 wherein the reciprocation of the movable jaw 84 toward the stationary jaw 82 of the rock crusher mechanism 80 assures that particles entering through the slurry transition throat 70 are of a size sufficient to pass therethrough without obstructing or blocking the transition throat 70.

Upon passing through the slurry transition throat 70, the slurry 110 is drawn through the eductor venturi 46 and is mixed within the eductor mixing section 48 by the liquid being discharged through the jet pump nozzle 42. The resultant slurry liquid mixture travels upward through the eductor conduit 24 preferably being deposited in a surge tank (not shown) located on the ground surface 16 and subsequently processed by conventional means to separate the bitumen from the sand particle slurry.

As may be recognized, this process may be continued throughout the height of the tar sand formation 20 with the lowering of the mining section 10 being facilitated by the digging of the Archimedes feed screw 52. Similarly, once the height of the tar sand formation 20 has been mined, an additional bore hole 14 may be formed at an adjacent drilling location, and the mining section 10 may again be lowered therein. By such a procedure, the entire tar sand formation 20 may be efficiently mined by use of a plurality of bore holes 14 with the previously mined bore holes tailings (not shown) being subsequently injected back into the bore holes 14 to prevent environmental degradation.

Thus, from the above, it will be recognized that due to the present invention utilizing both radial and bottom slurry inlets, a continuous quantity of tar sand is supplied within the slurry transition throat 70 and carried to the ground surface 16 through the eductor conduit 24. This continuous supply insures consistent operating efficiency throughout the mining process. Further, by use of the rock crusher mechanism 80 of the present invention, the mining tool 10 may be operated in varying tar sand formations without being clogged or obstructed by large mineral particles lodging within the slurry transition throat 70. Additionally, the incorporation of an Archimedes screw feed at the lower end of the mining section 10 permits the mining tool to be continuously lowered throughout the height of the tar sand formation 20. Those skilled in the art will recognize that chemical additive amenable to promoting the separation of the crude oil from the tar sands may be supplied to the high velocity liquid discharge of the mining tool and that further, the liquid discharge may be heated at the surface to enhance the crude oil/sand separation during operation.

Thus, in summary, the present invention provides a significantly improved hydraulic mining tool apparatus which increases mining efficiencies, eliminates the tendency of the jet pump obstruction, and is adaptable for use in varying tar sand formations.

I claim:

1. In a hydraulic mining tool for recovering minerals from subterranean formations, including a hydraulic cutting jet for dislodging said minerals from said formations and forming a resultant mineral slurry, and a hydraulic venturi pump for lifting said mineral slurry to ground surface, the improvement comprising:

an Archimedes screw carried on one end of said mining tool and disposed below said hydraulic venturi pump for transporting a continuous quantity of said minerals toward said hydraulic venturi pump; said Archimedes screw including a sleeve rigidly attached about a portion of its diameter to direct said continous quantity of minerals toward said hydraulic venturi pump; said Archimedes screw and said sleeve being axially spaced from said one end of said mining tool with said axial spacing defining a radial inlet for said mineral slurry into said hydraulic venturi pump; and said Archimedes screw and sleeve being mounted to said one end of said mining tool by means for adjusting said axial spacing to vary the size of said radial inlet.

2. The hydraulic mining tool of claim 1 wherein said adjusting means comprises plural struts rigidly connected to said one end of said mining tool and releasably connected to said sleeve to permit said sleeve to be axially reciprocated along the length of said strut.

3. In a hydraulic mining tool for recovering minerals from subterranean formations, including a hydraulic cutting jet for disloding said minerals from said formations and forming a resultant mineral slurry, and a hydraulic venturi pump for lifting said mineral slurry to ground surface, the improvement comprising:

a feed screw carried on one end of said mining tool and disposed below said venturi pump for transporting a continuous quantity of said minerals toward said hydraulic venturi pump; and means for crushing particulate matter carried by said resultant mineral slurry, said means positioned within the interior of said mining tool and disposed between said hydraulic venturi pump and said feed screw, said means comprising:

a fixed jaw positioned on one side of said hydraulic venturi pump;

a movable jaw pivotally mounted on the opposite side of said hydraulic venturi pump and aligned with said fixed jaw; and motive means for selectively reciprocating said movable jaw toward and away from said fixed jaw to crush said particulate matter between said fixed and movable jaws.

4. The hydraulic mining tool of claim 3 wherein said motive means comprises a hydraulic actuator interconnected to said hydraulic cutting jet and said hydraulic venturi pump.

5. The hydraulic mining tool of claim 4 wherein said hydraulic actuator additionally includes means for varying the speed and cycle frequency of said reciprocation of said movable jaw.

6. The hydraulic mining tool of claim 5 wherein said varying means comprises a butterfly valve connected in parallel between said hydraulic actuator and said hydraulic cutting jet and said hydraulic venturi pump to meter hydraulic flow into said hydraulic actuator.

7. In a hydraulic mining tool for recovering bitumen from subterranean mineral formations, including a hydraulic cutting jet for dislodging said bitumen from said formation and forming a resultant bitumen slurry, a hydraulic venturi pump for lifting said slurry to ground surface, and an inlet adjacent one end of said mining tool to permit ingress of said slurry to said hydraulic venturi pump, the improvement comprising:

a feed screw carried on said one end of said mining tool and disposed below said inlet for transporting a continuous quantity to said mineral formation toward said hydraulic venturi pump; and means for crushing particulate matter contained within said slurry and said quantity of said mineral formation to eliminate obstruction of said hydraulic venturi pump, said crushing means positioned between said hydraulic venturi pump and said feed screw and comprising:

a first jaw, positioned adjacent one end of said mining tool and disposed on one side of said hydraulic venturi pump;

a movable jaw mounted on the opposite end of said hydraulic venturi pump and aligned with said fixed jaw; and motive means for selectively driving said movable jaw toward and away from said fixed jaw.

8. The hydraulic mining tool of claim 7 further comprising means for introducing a supplemental quantity of liquid adjacent said one end of said mining tool to mix with said quantity of said mineral formation transported by said feed screw and yield a slurry mixture.

9. The hydraulic mining tool of claim 8 wherein said introducing means comprises a flow conduit connected to said hydraulic venturi pump and extending adjacent said one end of said mining tool.

10. The hydraulic mining tool of claim 7 wherein said feed screw comprises an Archimedes screw mounted to said one end of said mining tool by means for permitting said screw to be selectively axially spaced from said one end of said mining tool.

11. The hydraulic mining tool of claim 7 wherein said motive means further includes means for varying the speed and cycle frequency of said driving of said movable jaw.

* * * * *